United States Patent [19]

Scholl

[11] Patent Number: 4,462,320

[45] Date of Patent: Jul. 31, 1984

[54] WORKHOLDER FOR AN AUTOMATIC SEWING MACHINE

[75] Inventor: Hans Scholl, Oerlinghausen-Lipperreihe, Fed. Rep. of Germany

[73] Assignee: Kochs Adler AG, Bielefeld, Fed. Rep. of Germany

[21] Appl. No.: 513,165

[22] Filed: Jul. 13, 1983

[30] Foreign Application Priority Data

Jul. 23, 1982 [DE] Fed. Rep. of Germany ... 8221044[U]

[51] Int. Cl.[3] ..... D05B 19/00; D05B 3/12

[52] U.S. Cl. ..... 112/104; 112/121.12; 112/121.15; 112/303; 112/311; 112/114

[58] Field of Search ..... 112/121.12, 121.11, 112/121.15, 121.29, 104, 113, 114, 303, 308, 309, 311

[56] References Cited

U.S. PATENT DOCUMENTS

| | | | |
|---|---|---|---|
| 3,104,637 | 9/1963 | Hedegaard | 112/104 |
| 3,981,254 | 9/1976 | Franklin et al. | 112/114 |
| 4,022,139 | 5/1977 | Carson | 112/104 X |
| 4,160,423 | 7/1979 | Scholl | 112/121.12 |
| 4,282,819 | 8/1981 | Sartor | 112/303 X |

*Primary Examiner*—H. Hampton Hunter
*Attorney, Agent, or Firm*—Max Fogiel

[57] ABSTRACT

A workholder for a sewing machine for producing a stitch row in a workpiece according to a predetermined contour. The movably arranged workholder has a cut-out essentially formed according to the stitch contour and is controlled with respect to the needle by means of a feeding device incorporating a linkage system and a control disc. In particular, a new frame-type workholder with an additional workpiece clamp is provided for rendering possible the production of a decorative stitch row in connection with a label fastening stitch row.

6 Claims, 6 Drawing Figures

WORKHOLDER FOR AN AUTOMATIC SEWING MACHINE

BACKGROUND OF THE INVENTION

This invention relates in general to a workholder for a sewing machine for producing a stitch row in a workpiece according to a predetermined contour. The movably arranged workholder having a cutout essentially formed according to the stitch contour, is controlled with respect to the needle by means of a feeding device incorporating a linkage system and a control disc. In particular, a new workholder with additional workpiece clamping means is provided.

With advanced sewing automation, decorative stitches are applied on a workpiece or in conjunction with parts to be attached to such workpieces, such as a pocket for example. On the other hand, especially on blue jeans as well as other garment workpieces, labels are attached where the label attaching process requires a separate operation. Especially in an operation for attaching pockets in a symmetric arrangement to a garment, it may occur that one of the pair of pockets carries both a label and a decorative stitch row whereas the other pocket carries a decorative stitch row only. With application, both decorative stitch rows are of uniform profile except that area where the label is attached to the pocket as the label partially overlaps the decorative stitch row. Frequently such decorative stitches are characterized by closed stitch rows which are difficult to produce.

In U.S. Pat. No. 4,160,423 there is illustrated a sewing device for making slit facings of a garment such as a sleeve placket, for example. From this reference it is known to employ a workholder having a clamping plate, around which a closed stitch row is being produced. In order to render this possible, the clamping plate is tiltably situated at the workholder. Due to this arrangement there is achieved that the sewing head displaces the workpiece holder as the sewing head performs the last portion of the stitch row for closing the latter.

In general it is known to employ a frame-type workholder for the manufacture of a decorative stitch row in a workpiece. In such a type of workholder, the workpiece is clamped at its outer margin, so that there exists no restriction inside of the frame, as far as the movement of the needle with respect to the sewing area is concerned.

Accordingly, it is a main object of the present invention to create a frame-type workholder for a workpiece for producing a contoured stitch row having a decorative stitch row and a fastening stitch row for attaching a label to the workpiece in one operation.

It is a further object of this invention to construct a workholder of the aforesaid type and making it possible to produce the fastening stitch row over the total marginal circumference of the label.

Still a further object of this invention is to provide a workholder of the aforesaid type that assures the correct positioning of the label to be attached with respect to the decorative fastening stitch row.

Another important object of this invention is to create a workholder which can be employed without modification for generating a decorative stitch row in a workpiece or for generating a fastening stitch row to attach a label to a workpiece only.

Still another object of this invention is to provide a workholder for a sewing machine for increasing production while reducing the skill of the operator required for producing decorative stitch rows of complicated geometry but having a uniform appearance.

A further object of this invention is to provide a workholder of the aforesaid type to reduce the costs for producing such decorative stitch rows including label attaching where high and uniform quality is achieved.

Still another object of the present invention is to provide a workholder of the aforegoing character which is simple in construction and reliable in operation.

SUMMARY OF THE INVENTION

The objects of the present invention are achieved by installing an additional clamping plate in the workholder profiled with a recess. The clamping plate operates in a portion of the recess and is tiltably fastened to the workholder to make possible a displacement of the clamping plate in the plane of the workholder. With the arrangement of the clamping plate in the workholder it is possible to produce a decorative stitch row in a workpiece, on one hand, and beside this decorative stitch row, to also attach a label to the workpiece, on the other hand, in the same operation. In this operation, for example, at first a decorative stitch row can be produced and subsequently the label can be stitched to the workpiece. Almost at the end of generating the label attaching stitch row, the clamping plate is laterally displaced so as to clear the way for the needle for terminating, i.e. closing the label attaching stitch row of its complete marginal circumference.

The provision of a recess for the clamping plate allows also the use of the workholder for the production of decorative stitches only. In such a manner, it is possible to continuously produce a pair of workpieces, for example pockets, since only one of them is provided additionally with a label; the other one is provided with a decorative stitch row only. In this case, it is necessary that a feeding device controlling the relative motion between the needle and the workholer is capable for controlling both, the decorative stitch row including the label fastening stitch row, and the stitch row for producing the decorative stitch row only.

Arranging a clamping plate tiltably to the workholder by means of a bolt acting as a stop in conjunction with a tension spring, is a simple and reliable construction. It is achieved at by the lateral displacement of the clamping plate with respect to the workholder being carried out by the relative motion between the sewing head and the workholder, i.e. in a simple manner that does not require additional drive elements.

Other objects and advantages of the invention will become apparent from the following description, and novel features will be particularly pointed out in the claims.

DESCRIPTION OF A PREFERRED EMBODIMENT

Figure 1:
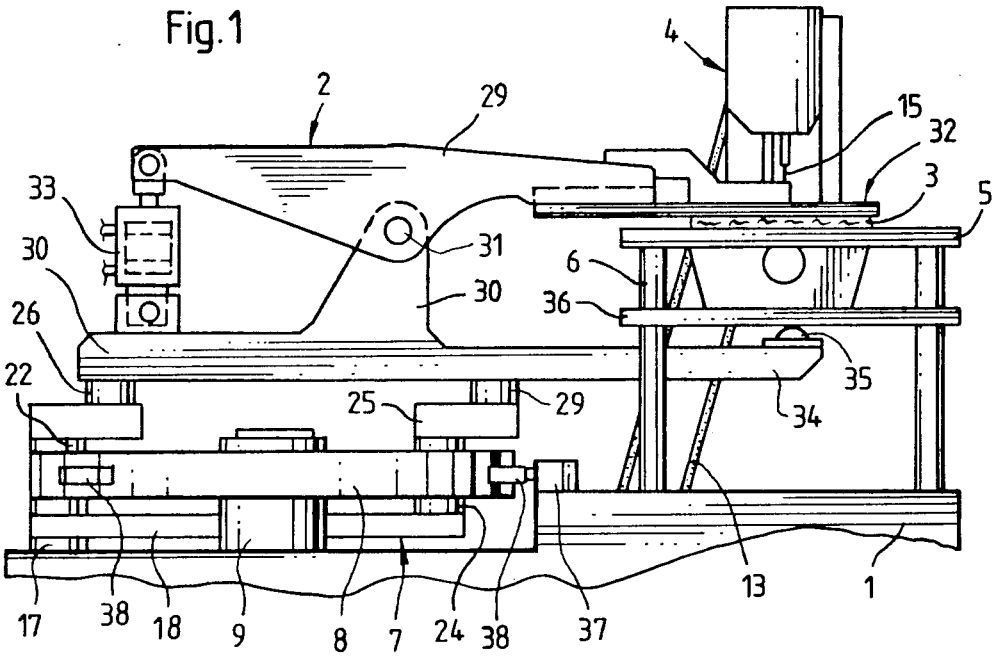
FIG. 1 is a front view of an automatic sewing machine.

FIG. 1 refers to an automatic sewing machine having a stand 1 for receiving a feeding device 2 for a workpiece 3 and a sewing head 4. The sewing head 4 is arranged on a plate 5, which is supported with respect to the stand 1 by means of posts 6.

The feeding device 2 is provided with a linkage system 7, which, in principle, consists of links pivotally arranged in a configuration of a quadrangle, and cooperates with a control disc 8. The control disc 8 is secured to a drive shaft 9 of a gear 10 mounted on the stand 1. The control disc 8 is driven via the gear 10 by means of a drive motor 11 of the automatic sewing machine situated inside the stand 1. The motor 11 is drivingly connected to a handwheel 14 of the sewing head 4 via a clutch 12 and a belt drive 13 and causes, depending on the clutch 12 being engaged, the drive of a needle 15 of the sewing head 4. A further belt drive 16 connects the motor 11 to the gear 10.

The linkage system 7 is provided with a fixed fulcrum formed by an axis 17, which is secured to the stand 1. On the axis 17 there is rotatably supported a guide lever 18, which is arranged perpendicularly with respect to the main direction of the sewing head 4 and below the control disc 8. The guide lever 18 is provided with a guide roller 19 engaging a control groove 20 formed at the lower surface of the control disc 8.

A further guide lever 21 is rotatably supported on the axis 17 and arranged above the control disc 8. The guide lever 21 extends perpendicularly with respect to the lower guide lever 18, i.e. in parallel with the main direction of the sewing head 4. The guide lever 21 is formed with a downwardly projecting guide roller 22 engaging a control groove 23 located in the upper surface of the control disc 8. The control grooves 20, 23 extend as closed grooves around the total circumference of the control disc 8. They are, however, not formed circularly.

Figure 2:
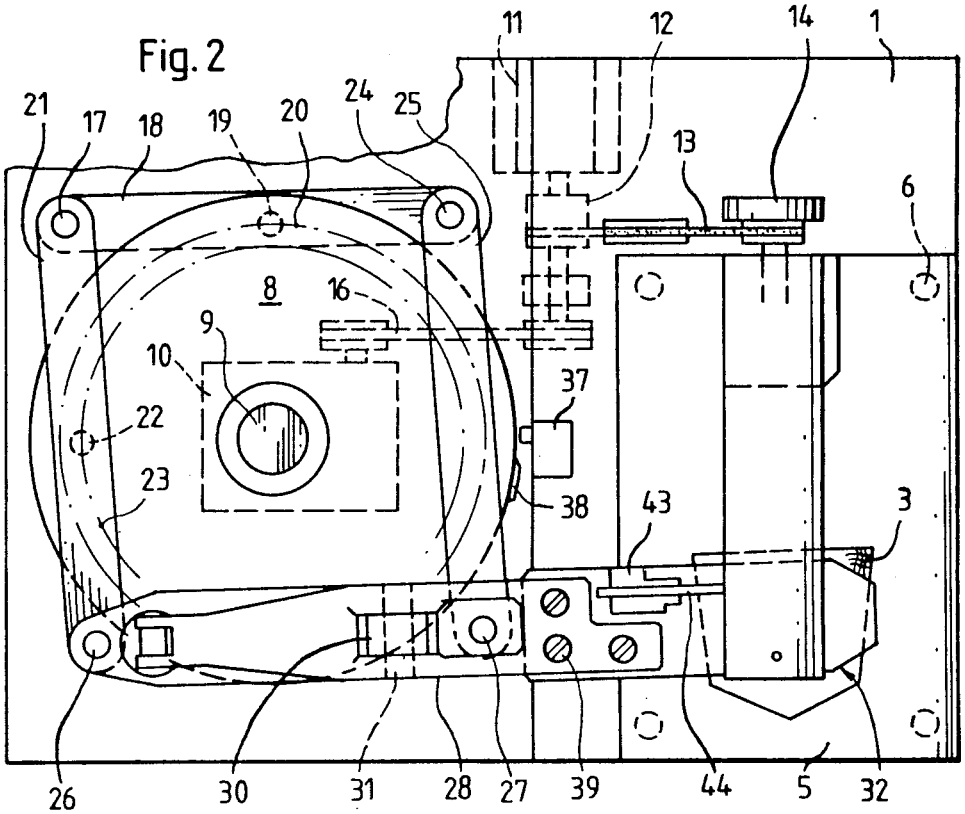
FIG. 2 is a top plan view of the automatic sewing machine according to FIG. 1.

To the end of the lower guide lever 18 turned away from the axis 17 and in parallel to the upper guide lever 21, there is hinged an intermediate lever 25 via a link 24. To the free ends of the upper guide lever 21 and the intermediate lever 25 turned away from the axis 17 and the link 24, respectively, there is hinged via links 26, 27 a drive lever 28 extending in parallel with the lower guide lever 18. The drive lever 28 is located above the plane set by the upper guide lever 21 and the intermediate lever 25. According to FIG. 2, the linkage system 7 defined by the four joints 17, 24, 26, 27 is a parallelogramlink-system having nearly right angles and equal shanks.

On the drive lever 28 there is arranged a bearing block 30 for supporting a bracket 29, which is rotatable about a horizontal axis 31 extending perpendicularly to the longitudinal direction of the drive lever 28, i.e. perpendicularly to the connecting line of the links 26, 27. To the free end of the bracket 29 there is mounted a workpiece holder 32.

The bracket 29 is movable by means of an air cylinder drive 33, which, at the surface turned away from the sewing head 4, is mounted, on one hand, to the drive lever 28 and, on the other hand, to the bracket 29. When energized, the air cylinder 33 is shortened as to move the workpiece holder 32 upwardly from a working position according to the drawing into a position (not shown). In order to ensure, that sufficient pressing forces are available while the air cylinder 33 is extended and while the workpiece holder 32 is lowered for the sewing operation, the drive lever 28 is provided with a counter support arm 34 extending below the workpiece holder 32. The counter support arm 34 is formed with a supporting roller 35 movably abutting against a pressure plate 36 fastened to the posts 6.

On the stand 1 there is mounted a stationary electrical switch 37 cooperating with trigger cams 38 secured to the circumference of the control disc 8. At a predetermined angular position of the control disc 8, the trigger cams 38 effect a switching operation, i.e. a signal, which is transmitted to an electronic control circuit.

The workpiece holder 32, fastened by screws 39 to the drive lever 28, is formed with a recess 40, which is profiled with a chamfer 41 over its total extension. The configuration of the recess 40 corresponds beside a necessary distance to the configuration of the seam to be carried out in the workpiece 3.

On the workpiece holder 32 there is mounted a pivot pin 42 extending upwardly and in parallel with the needle 15 for rotatably receiving a bearing block 43. In the bearing block 43 there is rotatably supported a double-armed lever 44 by means of an axis 45 which extends perpendicularly with respect to the pivot pin 42. The double-armed lever 44 carries, at its free end, a clamping plate 46 projecting in its lowered position into a portion 40′ of the recess 40.

Figure 3:
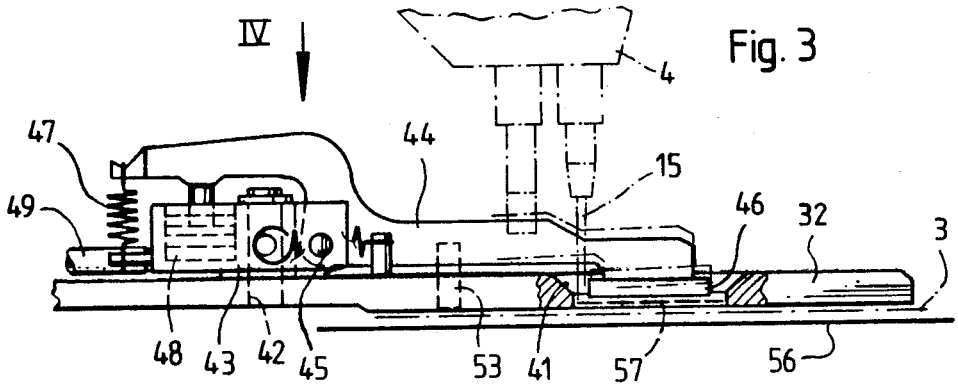
FIG. 3 is a partially sectional view of FIG. 1, on an enlarged scale.

The other end of the double-armed lever 44 is provided with a pretensioned tension spring 47, the other end of which is suspended at the bearing block 43. The spring 47 tends to move the clamping plate 46 from the position as illustrated in FIG. 3, into a lifted dot-dash-lined position. To the side of the axis 45 turned toward the tension spring 47, there is arranged an air cylinder 48, which is connected to a compressed air connection 49 for pressing the clamping plate 46 downwardly into its working position.

To the bearing block 43 there is secured a bolt 50, at which is suspended a tension spring 51, the other end of which is fastened to a bolt 52 located at the workpiece holder 32. The spring 51 is arranged so as to steadily create a torque for rotating the lever 44 and the bearing block 43 in counter-clockwise direction according to FIG. 4, so that the clamping plate 46 is always moved into the direction of the sewing head 4 against a stop 53 formed at the workpiece holder 32.

On the sewing head 4 there is arranged a shifter rod 55 extending in parallel with a needle bar 54 carrying the needle 15. The shifter rod is in a place where usually a presser foot bar is situated. When the workpiece holder 32 is displaced relative to the sewing head 4, the lever 44 together with the clamping plate 46 in a lifted position, will be displaced in clockwise direction off the stop 53 about the pivot pin 42 into a dot-dash-lined position as illustrated in FIG. 4.

Figure 4:
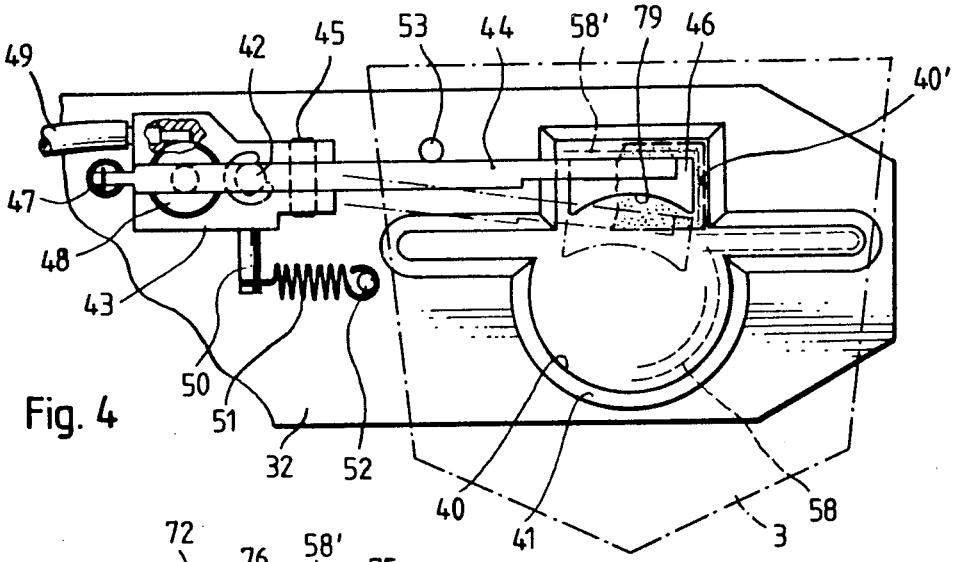
FIG. 4 is a top plan view of the sectional view in the direction of the arrow IV in FIG. 3.
Figure 5:
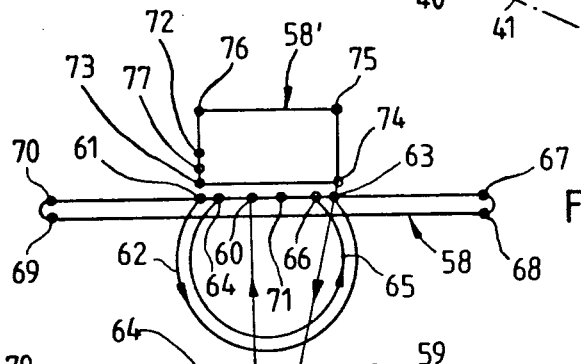
FIG. 5 shows the contour of a seam including a decorative seam and a label fastening seam.

Operation of the preferred embodiment may be described as follows:

In describing the operation, as starting position is assumed, in which the needle 15 is located above a point 60 as illustrated in FIG. 5, and in which the workpiece holder 32 is in a lifted position with respect to a workpiece supporting plate 56. The clamping plate 46 is also lifted and located in the dot-dash-lined position according to FIG. 3. The lever 44 rests against the stop 53, i.e.

the clamping plate is located—relative to its horizontal projection—in the position shown in solid lines in FIG. 4.

Figure 6:
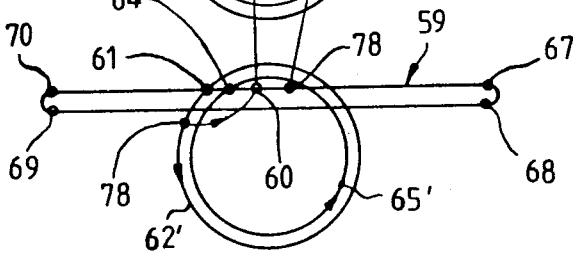
FIG. 6 shows the contour of a decorative seam.

The workpiece 3 comprising a pocket cut is positioned according to visual marks (not shown) on the workpiece supporting plate 56. Subsequently, the workpiece holder 32 is lowered upon the workpiece 3 by means of the energized air cylinder drive 33. As the clamping plate 46 is still in its lifted position, a label 57 may be inserted into the portion 40' of the recess 40 between the workpiece 3 and the clamping plate 46. Then, the clamping plate 46 is lowered by the clamping plate drive 48 which is energized by compressed air pressure for pressing the label 57 onto the workpiece 3. Subsequently, the automatic sewing machine is started, at which time the clutch 12 is engaged so as to cause the drive motor 11 to drive the sewing head 4 and the linkage system 7. The subsequently produced seam 58 or 59 is illustrated in FIG. 6 as a solid line. When producing the seam, the workpiece holder 32 together with the workpiece 3 and the label 57 is moved relative to the needle 15.

Starting from the point 60, the needle 15 performs a seam in a straight direction up to a point 61, and then along an outer circular arc section 62 up to a point 63, which in turn is in alignment with a line extending through the points 60, 61. From the point 63 it is sewn along the aforementioned line to a point 64 and then along an inner circular arc section up to a point 66, also in alignment with the points 60, 61, 63, 64. From the point 66 it is sewn via the points 67, 68, 69, 70 along two substantially parallel extending straight lines having at their ends short roundings, and then back to a point 71, by which overlapped stitches, i.e. a certain back-tacking is performed. At this point a thread cutting operation follows. Subsequently, the clutch 12 is shifted so as to drive only the linkage system 7, so that the needle 15 is in a position above a point 72 and above the label 57 for starting the rectangular seam 58'. The point 72 is located adjacent to the lever 44, so that the lever 44 still rests against the stop 53. The needle 15 and also the shifter rod 55 are located—relative to the illustration in FIG.4—below the lever 44.

Subsequently, the seam 58' is sewn in counter-clockwise direction via the corner points 73, 74, 75, 76. After sewing the last corner point 76, a signal is transmitted to the electric control by the cam 38 so as to lift the clamping plate 46 off the label 57, thereby making possible a lateral displacement of the clamping plate 46 together with the bearing block 43 in clockwise direction against the force of the spring 51. consequently, the seam 58' can be closed. Furthermore, by over-sewing the initial point 72 up to an end point 77, seam securing tack stitches are achieved. Subsequently, a thread cutting cycle is carried out. Also the second sewing cycle for producing the seam 58' is performed in a clutch position, of course, in which both the sewing head 4 and the linkage system 7 are driven.

Now, the clutch 12 is again disengaged, so that the drive connection to the sewing head 4 is released. The workpiece holder 32 is displaced backwardly so as to move back the needle 15 via the corner points 76, 75, 74 to the starting point 60. When moving from the point 77 to the point 76, the lever 44 is moved back by the action of the spring 51, and abuts against the stop 53. When the needle 15 again has reached the position above the starting point 60, the clamping plate 46 and the workpiece holder 32 assume their upper position so that the stitched workpiece 3 provided with the label 57 and a decorative seam 58 can be removed.

If seam contours according to FIG. 5 shall be only produced, a complete seam contour is contained in the control cams 20, 23, i.e. the control disc 8 performs one revolution for producing such a seam.

However, it is also possible to produce seams according to FIGS. 5 and 6 alternately, whereby the seam contours according to the seam 58 together with the seam 58' and according to the seam 59 must be included in one revolution of the control cams 20, 23.

In this case, the needle 15 is moved from the point 74 to a point 78 and from here via the points 70, 69, 68, 67 to the point 64. Consequently, the two straight lines will be sewn at first and the inner circular arc 65' up to point 64. Now a short section in a straight direction is sewn up to the point 61, then the seam extends along the circular outer arc 62' and back to the point 61 and further to a point 78' in order to secure the seam by overlapping stitches. The sewing of the circular arc portions exceeding the circular arc sections 62 or 65 provides no problems, as the clamping plate 46 is provided with a correspondent recess 79. When reaching the point 78' a thread cutting operation takes place. Subsequently, the sewing head 4 is disconnected from the drive motor 11 by the corresponding actuation of the clutch 12 so as to carry out a displacement of the workpiece holder 32 with respect to the needle 15, whereby the latter is finally positioned above the point 60. Now, the workpiece 3 only, provided with a decorative seam 59, can be removed and subsequently a succeeding workpiece 3 and a label 57 can be inserted and provided with a seam as described.

What we claim is:

1. A sewing machine for producing a stitch row in a workpiece according to a predetermined contour, comprising:
   - stitch forming means including a needle reciprocatingly driven on a path;
   - a plate supporting said workpiece in a plane extending substantially perpendicular with respect to said path; and
   - feeding means for generating a relative feed movement between said workpiece and said needle in accordance with said contour, said feeding means comprising:
     - holding means for said workpiece and
     - a cutout substantially profiled according to said contour and located in said holding means and representing a work area,
       - said holding means comprising:
       - a clamping plate extending in a portion of said cutout and being displaceably arranged in said work area and with respect to said latter.

2. A sewing machine according to claim 1, wherein said clamping plate is formed with at least one recess substantially profiled according to a section of said stitch row.

3. A sewing machine for producing a stitch row in a workpiece according to a predetermined contour, comprising:
   - stitch forming means including a needle reciprocatingly driven on a path;
   - a plate supporting said workpiece in a plane extending substantially perpendicular with respect to said path; and
   - feeding means for generating a relative feed movement between said workpiece and said needle in accordance with said contour, said feeding means comprising:

holding means for said workpiece and a cutout substantially profiled according to said contour and located in said holding means and representing a work area;

said holding means comprising:

bearing means including a tilt axis extending perpendicular with respect to said work area;

an arm received in said bearing means and pivotable about said tilt axis;

a clamping plate fastened to said pivotable arm, extending into a portion of said cutout and profiled substantially according to said portion, and drive means for controlling the position of said clamping plate with respect to said portion in accordance with the stitch row generation.

4. A sewing machine according to claim 3, wherein said bearing means further includes a bearing block pivotably arranged about said tilt axis, said bearing block being formed with a pivot extending about a further axis in parallel to said work area for liftably receiving said arm with said clamping plate and being formed with a drive member for positioning said arm with said clamping plate relative to said bearing block.

5. A sewing machine for producing a decorative stitch row and a fastening stitch row according to a predetermined contour, comprising:

a stand;

a sewing head received by said stand and comprising:

stitch forming means including a needle reciprocatingly driven on a path;

a plate supporting a workpiece in a plane extending substantially perpendicular with respect to said path; and shift member;

drive means driving said sewing head; and feeding means operably connected to said drive means for generating a feed movement between said workpiece and said needle in accordance with said contour;

said feeding means comprising:

a workholder for said workpiece formed with a cutout substantially profiled according to said contour and representing a work area, said workholder comprising:

a bolt extending perpendicular with respect to said work area;

a bearing block pivoted on said bolt and formed with a pin extending in parallel to said work area and having a drive cylinder;

a spring suspended between said workholder and said bearing block;

a stop limiting said spring-forced bearing block in one end position;

an arm pivotally received on said pin operably connected to said cylinder and occasionally cooperating with said shift member for tilting said bearing block against the tension of said spring, and a clamping plate formed on said arm and applicable for clamping a label onto said workpiece within said work area;

said clamping being formed substantially according to said fastening stitch row to be produced for attaching said lable to said workpiece.

6. A sewing machine according to claim 5, wherein said clamping plate is formed with at least one recess clearing a section of said decorative stitch row.

* * * * *